US006449843B2

(12) United States Patent
Diewald et al.

(10) Patent No.: US 6,449,843 B2
(45) Date of Patent: Sep. 17, 2002

(54) METHOD FOR MANUFACTURING A HONEYCOMB BODY WITH A LARGE NUMBER OF FLUID PERMEABLE CHANNELS

(75) Inventors: Robert Diewald, Siegburg (AT); Manfred Vierkötter, Neunkirchen-Seelscheid (DE)

(73) Assignee: Emitec Gesellschaft für Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/729,063

(22) Filed: Dec. 4, 2000

Related U.S. Application Data

(63) Continuation of application No. PCT/EP99/03710, filed on May 28, 1999.

(30) Foreign Application Priority Data

Jun. 4, 1998 (DE) ..... 198 25 018

(51) Int. Cl.[7] ..... B23P 15/00
(52) U.S. Cl. ..... 29/890; 29/515
(58) Field of Search ..... 29/890, 515, 465, 29/466; 422/180

(56) References Cited

U.S. PATENT DOCUMENTS

| | | | | | |
|---|---|---|---|---|---|
| 4,923,109 | A | | 5/1990 | Cyron | |
| 6,029,488 | A | * | 2/2000 | Wieres | 29/890 |
| 6,049,961 | A | * | 4/2000 | Wieres | 29/505 |
| 6,049,980 | A | * | 4/2000 | Wieres | 29/890 |
| 6,115,906 | A | * | 9/2000 | Wieres | 29/505 |
| 6,226,867 | B1 | * | 5/2001 | Bruck et al. | 29/505 |
| 6,311,395 | B1 | * | 11/2001 | Wieres | 29/890 |
| 6,317,976 | B1 | * | 11/2001 | Aranda et al. | 29/465 |
| 6,365,283 | B1 | * | 4/2002 | Bruck | 29/890 |

FOREIGN PATENT DOCUMENTS

| | | |
|---|---|---|
| DE | 40 16 276 C1 | 6/1991 |
| DE | 195 25 262 A1 | 2/1996 |
| DE | 195 21 685 A1 | 12/1996 |
| DE | 195 22 327 A1 | 1/1997 |
| DE | 195 28 963 A1 | 2/1997 |
| EP | 0 322 566 A1 | 7/1989 |
| EP | 0 332 891 A1 | 9/1989 |

OTHER PUBLICATIONS

International Patent Application No. 97/00725 (Wieres), dated Jan. 9, 1997.

International Patent Application No. 97/00135 (Wieres), dated Jan. 3, 1997.

International Patent Application No. 94/01661 (Maus et al.), dated Jan. 20, 1994.

International Patent Application No. 90/03220 (Maus et al.), dated Apr. 5, 1990.

* cited by examiner

*Primary Examiner*—I Cuda Rosenbaum
(74) *Attorney, Agent, or Firm*—Laurence A. Greenberg; Werner H. Stemer; Ralph E. Locher

(57) ABSTRACT

To manufacture a honeycomb body, it is proposed that at least one stack is layered up from a plurality of at least partly structured sheet metal layers. Each stack is folded over about a bending line such that a sheet metal pack is formed having a curved first end area and a second end area. The second end area has a first end section and a second end section. A first end face of the first end section forms a first angle with a central plane, and a second end face of the second end section forms a second angle with the central plane, wherein the first angle is smaller than the second angle. The sheet metal packs are held by looping devices disposed in a mold, and the sheet metal pack is looped into a honeycomb body by rotation of the looping devices.

8 Claims, 2 Drawing Sheets

METHOD FOR MANUFACTURING A HONEYCOMB BODY WITH A LARGE NUMBER OF FLUID PERMEABLE CHANNELS

CROSS-REFERENCE TO RELATED APPLICATION

This is a continuation of copending International Application PCT/EP99/03710, filed May 28, 1999, which designated the United States.

BACKGROUND OF THE INVENTION

Field of the Invention

The subject-matter of the invention relates to a method and to a sheet metal pack for manufacturing a honeycomb body with a large number of fluid permeable channels.

Metallic honeycomb bodies are known which are used as catalytic converter supporting bodies. Such a honeycomb body is composed of a large number of at least partly structured sheet metal layers. Numerous examples of the configuration of a honeycomb body are known from, for example, U.S. Pat. No. 4,923,109, International Patent Disclosure WO 90/03220, Published, European Patent Application EP 0 322 566 A1 and International Patent Disclosure WO 94/01661. International Patent Disclosure WO 97/00725 deals with the manufacturing of a honeycomb body with a large number of fluid permeable channels made from a large number of at least partly structured layers. This reference proposes that at least one stack of a plurality of at least partly structured sheet metal layers is layered up. Each stack is folded over on itself about a bending line in order to construct a sheet metal pack. Each sheet metal pack is disposed in a mold that has a contour corresponding to the external shape of the honeycomb body to be manufactured. Each stack is held by a looping device disposed in a central area of the mold. All the stacks are subsequently looped into a honeycomb body by rotation of the looping device relative to the mold. The honeycomb body prepared in this manner is subsequently fitted into a casing tube. A further method for manufacturing a honeycomb body is known from International Patent Disclosure WO 97/00135.

In further manufacturing steps, the honeycomb body is brazed to the casing tube. With this, it is substantially the end areas of the individual sheet metal layers that are brazed to the casing tube. With honeycomb bodies manufactured in this way, there is the danger that by folding each stack over on itself and looping the stack into a honeycomb body, in the area where the individual sheet metal layers join the casing tube, some sheet metal layers are brazed to the casing tube pipe over a relatively large part of the periphery of the casing surface of the casing tube, while other sheet metal layers are only brazed to the casing tube over a relatively small section of the periphery. This type of joining of the honeycomb body to the casing tube carries the danger that the honeycomb body will be damaged because of its mechanical and thermal stressing. In particular, there is the danger that the brazed connection between individual sheet metal layers will be at least partially destroyed.

SUMMARY OF THE INVENTION

It is accordingly an object of the invention to provide a method and a sheet metal pack for manufacturing a honeycomb body with a large number of fluid permeable channels which overcome the above-mentioned disadvantages of the prior art methods and devices of this general type, which makes more even forming of a brazed connection to the jacket pipe possible.

With the foregoing and other objects in view there is provided, in accordance with the invention, a method for manufacturing a honeycomb body with a large number of fluid permeable channels. The method includes the step of forming a plurality of stacks by layering up a plurality of sheet metal layers for each of the stacks, some of the sheet metal layers are at least partly structured sheet metal layers. Each of the stacks are folded about a bending line resulting in a plurality of sheet metal packs being formed such that each of the sheet metal packs has a curved first end area and a second end area opposite the first end area. The second end area has a first end section and a second end section. The first end section has a first end face forming a first angle with a central plane, the second end section has a second end face forming a second angle with the central plane. The first angle is smaller than the second angle. A mold having a central area and looping devices are provided. Each of the sheet metal packs is fastened to one of the looping devices and the looping devices are disposed in the central area of the mold. The looping devices are rotated relative to the mold for forming the sheet metal packs into the honeycomb body.

In accordance with the method according to the invention for manufacturing the honeycomb body with a large number of fluid permeable channels, it is proposed that at least one stack is formed from a plurality of at least partly structured sheet metal layers, which are layered up. Afterwards, each stack is folded over on itself about the bending line to form the sheet metal pack such that the sheet metal pack has a curved first end area and a second end area opposite the first end area. The folding over of the stack on itself to form the sheet metal pack is done such that the second end area is formed by a first end section and a second end section of the stack. The first end section has a first end face. The second end section has a second end face. The first end face and the second end face together form an end face of the second end area of the sheet metal pack. The end faces are inclined relatively towards one another. The first end face forms a first angle $\alpha$ with a central plane, which is formed for example by a central sheet metal layer of the sheet metal pack which is folded over on itself. The second end face forms a second angle $\beta$ with the central plane. The angle $\beta$ and the angle $\alpha$ are inclusive angles. The angles are selected such that the first angle $\alpha$ is smaller than the second angle $\beta$. This is obtained in that during folding the sheet metal layers in the first end section are displaced substantially more greatly relative to one another than the sheet metal layers in the second end section. In principle, the second end area of the stack of sheet metal is configured asymmetrically.

Each sheet metal pack is then held by a looping device disposed in the central area of a mold and looped into a honeycomb body by rotation of the looping device relative to the mold.

Unexpectedly, it has been shown that by the implementation of the method according to the invention when forming the honeycomb body, the honeycomb body has relatively evenly distributed sheet metal layer end parts, viewed in the direction of the periphery, so considerably more even brazing of the honeycomb body to the casing tube is possible. Because the honeycomb body can be more evenly brazed, a greater degree of operational reliability of the honeycomb body can be obtained.

According to an advantageous further development of the method, it is proposed that during the folding of the stack a considerably greater relative displacement of the sheet metal layers is permitted in the first end section than in the second end section. It is proposed in particular that during the folding, the sheet metal layers of the stack of the second end section are substantially stationary. In this way, the second end section of the sheet metal pack substantially retains the original shape of the end section as the stack. Different sheet metal stacks can also be provided with differently configured end sections, according to the number of stacks of sheet metal which are used for forming a honeycomb body, and according to the shape of the honeycomb body to be provided. By a combination of different sheet metal packs and by appropriate formation of the second end sections during the folding of the stack, the operational reliability of a honeycomb body can be increased.

To simplify the manufacturing of the honeycomb body, it is also proposed that at least during the folding, the stack is held in at least one area between the second end section and the bending line. This can be done, for example, by clamping the stack by the second end section. The clamping can also be such that it allows a certain displacement of the sheet metal layers.

Preferably, the stack is formed in that the sheet metal layers are layered up such that the second end face of the stack of the second end section is substantially perpendicular to the longitudinal direction of the stack. In particular, three stacks of this type are used for forming a honeycomb body.

According to a further preferred configuration it is proposed that at least one stack is layered up from at least partly structured sheet metal layers, and the sheet metal layers are substantially completely overlapping.

According to a further advantageous implementation of the method it is proposed that at least two sheet metal packs are disposed in a mold. The curved end area of each of the sheet metal packs is disposed in a central area of the mold. Each sheet metal pack is directed radially outwards as is known, for example, from International Patent Disclosure WO 97/00725. The sheet metal packs are held by the looping devices. The sheet metal packs are disposed in the mold such that when viewed in a peripheral direction, the first end section alternates with the second end section. This configuration of the sheet metal packs in the mold has the advantages that bending of each of the sheet metal packs takes place in the same direction. In this way, a more even distribution of the ends of each of the sheet metal layers of the sheet metal pack is also obtained when viewed in the peripheral direction, with each sheet metal pack.

According to yet another advantageous implementation of the method, it is proposed that the direction of rotation of the looping device is selected so that each sheet metal pack is bent around a respective axis of bending which is substantially parallel to the bending line and adjacent to a section of an outer sheet metal layer lying between the second end section and the curved end area.

According to a further inventive concept, the sheet metal pack is proposed for manufacturing the honeycomb body with a large number of fluid permeable channels. The sheet metal pack is composed of a plurality of at least partly structured sheet metal layers that are layered up and are folded over on themselves about a common bending line. The sheet metal pack has a curved first end area and a second end area opposite the first end area. The second end area is formed by a first end section and a second end section. The sheet metal pack is distinguished in that the first end section has a first end face and the second end section has a second end face, wherein the first end face encloses the first angle $\alpha$ with a central plane, and the second end face encloses a second angle $\beta$ with the central plane, wherein the first angle $\alpha$ is smaller than the second angle $\beta$. A sheet metal pack thus formed is suitable in particular for manufacturing a honeycomb body. The sheet metal pack can be looped according to the implementation of the method known from International Patent Disclosure WO 97/00725 or from International Patent Disclosure WO 97/00135 with other sheet metal packs of suitable configuration to form a honeycomb body, wherein a honeycomb body is obtained which has sheet metal ends which are distributed particularly evenly in the peripheral direction, so that a relatively even brazed connection between the honeycomb body and a jacket tube can be produced. Preferably, the sheet metal pack is configured such that the second angle $\beta$ is approximately 90°.

Other features which are considered as characteristic for the invention are set forth in the appended claims.

Although the invention is illustrated and described herein as embodied in a method and a sheet metal pack for manufacturing a honeycomb body with a large number of fluid permeable channels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
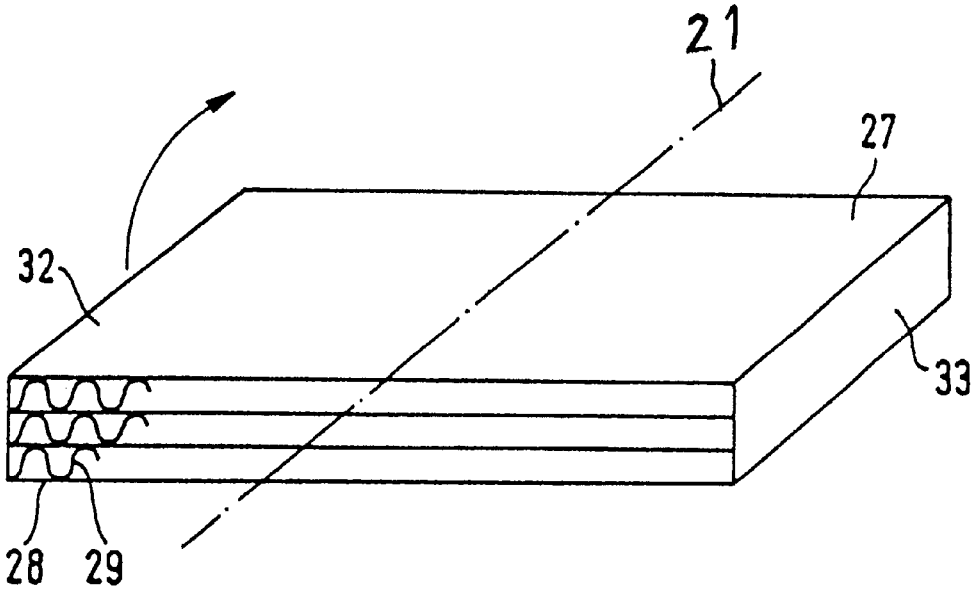
FIG. 1 is a diagrammatic, perspective view of a stack according to the invention.

In all the figures of the drawing, sub-features and integral parts that correspond to one another bear the same reference symbol in each case. Referring now to the figures of the drawing in detail and first, particularly, to FIG. 1 thereof, there is shown in a perspective representation, a stack 27. The stack 27 includes a large number of at least partly structured sheet metal layers 28, 29. The stack 27 in the representation according to FIG. 1 is formed from both flat sheet metal layers 28 and corrugated sheet metal layers 29. The flat sheet metal layers 28 and the corrugated sheet metal layers 29 are alternating. The flat sheet metal layers 28 and the corrugated sheet metal layers 29 completely overlap in the embodiment shown. They are layered one above another such that they form a prism with a rectangular base. A bending line 21 is shown in FIG. 1 by the broken line, about which the stack 27 is folded over on itself. The bending line 21 is substantially in the center of the stack 27.

Figure 2:
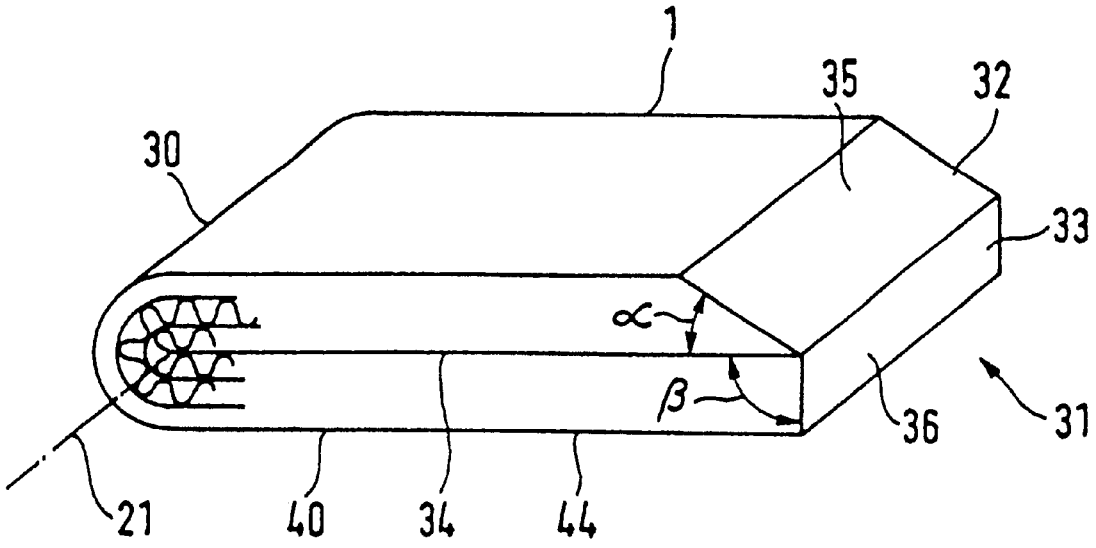
FIG. 2 is a perspective view of a sheet metal pack.

By folding the stack 27 over on itself and about the bending line 21, a sheet metal pack 1 is manufactured as is shown in FIG. 2 in an exemplary manner. The sheet metal pack 1 has a first end area 30. The end area 30 that is adjacent to the bending line 21 is curved. The sheet metal pack 1 has a second end area 31. The second end area 31 is opposite the first end area 30. The second end area 31 is formed by a first end section 32 and a second end section 33 of the stack 27.

The first end section 32 has a first end face 35. The first end face 35 is inclined towards the opposite first end area 30. The first end face 35 forms a first angle $\alpha$ with a central plane 34. The second end section 33 has a second end face 36. The second end face 36 forms a second angle $\beta$ with the central plane 34. As is visible from FIG. 2, the first angle $\alpha$ is smaller, in particular substantially smaller, than the second angle $\beta$. In the embodiment shown, the second angle $\beta$ is approximately 90°.

Figures 3, 4, 5, 6, 7, 8:
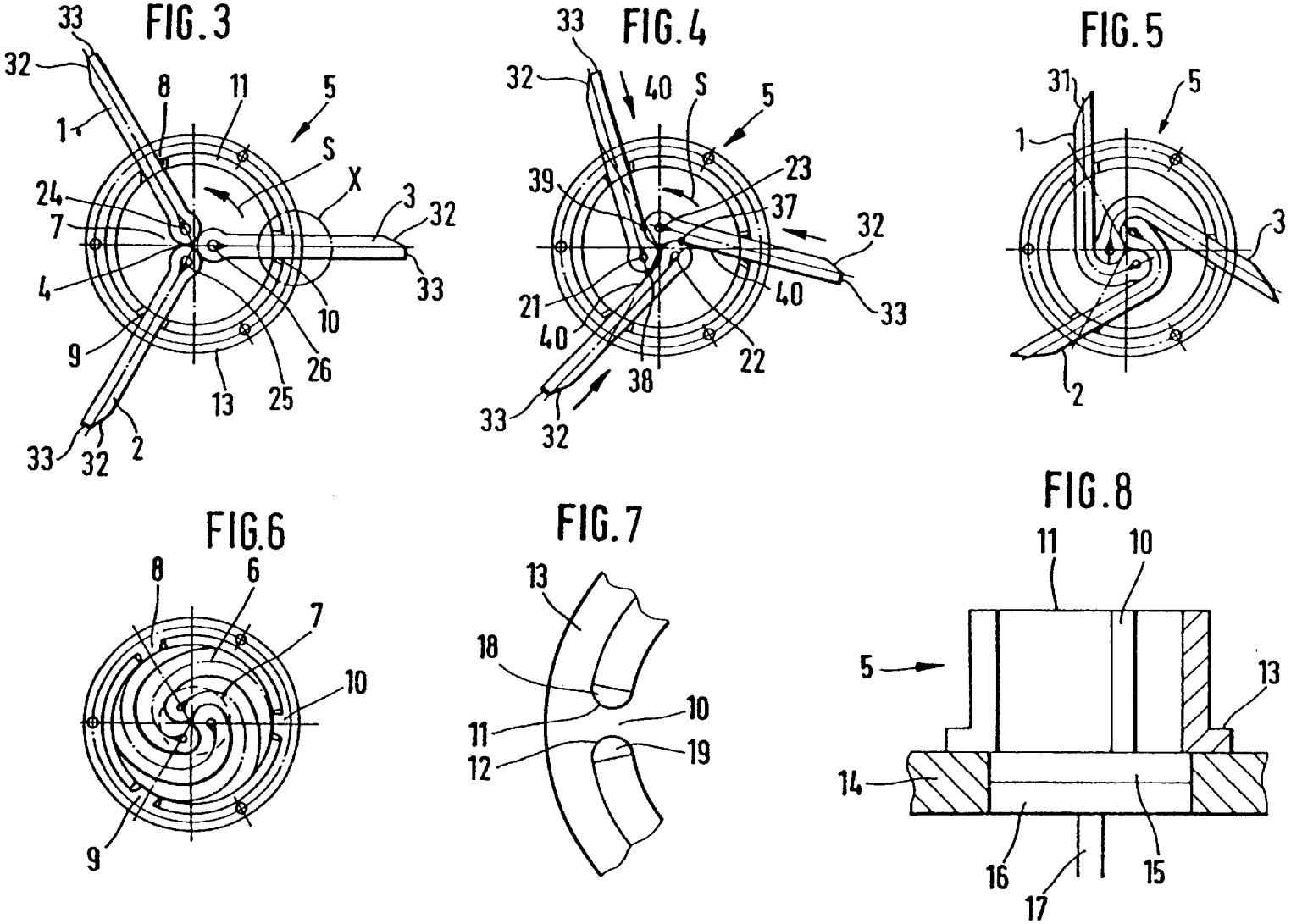
FIG. 3 is a plan view of a device with three sheet metal packs to be wound.
FIGS. 4 and 5 are plan views showing momentary states during a looping procedure.
FIG. 6 is a plan view f a completely wound honeycomb body in a mold.
FIG. 7 is an enlarged view of a detail X shown in FIG. 3.
FIG. 8 is a fragmented, cross-sectional view of the stack according to FIG. 3.

FIG. 3 shows a configuration of three sheet metal packs 1, 2, 3 in a mold 5 in a plan view. Each of the sheet metal packs 1, 2, 3 is disposed with its respective curved first end area 30 in a central area 7 of the mold 5. The sheet metal packs 1, 2, 3 extend radially outwards from the central area 7. The sheet metal packs 1, 2, 3 are disposed such that as seen in a peripheral direction, the first end section 32 alternates with the second end section 33.

The mold 5 includes a wall 11, three rectangular passages 8, 9, 10 of which are distributed equidistantly about the periphery in the embodiment shown. The mold 5 can be connected by connecting devices which are not shown by an outside flange 13 to a base plate 14, as is shown in FIG. 8. The base plate 14 is provided with a passage aperture 15, through which a die 16 that is disposed on an actuating rod 17 can be guided. The cross-section of the aperture 15 and of the die 16 corresponds to the cross-section of the mold 5. The passages 8, 9 and 10 have longitudinal surfaces 11 that are preferably configured convexly in cross-section, as shown in FIG. 7. Preferably, the longitudinal surfaces 11, 12 are provided with a sliding layer 18, 19 that is a sliding layer of ceramic material.

For better clarity, only parts of a looping device which can twist the sheet metal packs 1, 2, 3 about an axis 4 perpendicular to the plane of the drawing, are shown. The looping device has winding spindles 24, 25, 26 which engage with each of the sheet metal packs 1, 2 and 3 and rotate in the direction of rotation S. The winding spindles 24, 25, 26 engage with an area of the sheet metal pack 1, 2, 3 concerned, which is in the area of the bending line 21, 22, 23.

By twisting the winding spindles 24, 25, 26 about a central axis 4 in the direction S the individual sheet metal packs 1, 2 and 3 are looped in the same direction. During the winding procedure, the sheet metal packs 1, 2, and 3 slide along the sliding layers 18, 19 of each of the passages 8, 9, 10 into an interior of the mold 5. The individual sheet metal packs 1, 2, 3 are curved about bending axes 37, 38, 39. The respective bending axes 37, 38, 39 are substantially parallel to the bending line 21, 22, 23 and respectively to the winding spindle 24, 25, 26. It is adjacent to a section 40 of an outside sheet metal layer 44 of each of the sheet metal packs 1, 2, 3 lying between the second end section 33 and the curved end area 30. During the looping procedure, displacement of the bending axes 37, 38, 39 takes place. The position of the bending axes 37, 38, 39 is dependent upon the looped periphery of the sheet metal packs 1, 2, 3.

During the looping procedure a displacement of the sheet metal layers 28, 29 also takes place so that the second end area 31 substantially matches the internal shape of the mold 5. The displacement of the individual sheet metal layers 28, 29 is therefore such that an even distribution of the ends of the respective sheet metal layers 28, 29 occurs on the periphery of the honeycomb body 6.

The presently described device, by which the method for manufacturing a honeycomb body with a large number of fluid permeable channels is explained, represent a preferred embodiment. Alternatively, the method can also be carried out by the device described in International Patent Disclosure WO 97/00135 and the method described therein. The content of the International Patent Disclosure WO 97/00135 and of Non-Published, German Patent Application DE 195 21 685.7 are incorporated by reference herein in their entirety.

We claim:

1. A method for manufacturing a honeycomb body with a large number of fluid permeable channels, which comprises the steps of:

forming a plurality of stacks by layering up a plurality of sheet metal layers for each of the stacks, some of the sheet metal layers being at least partly structured sheet metal layers;

folding over each of the stacks about a bending line resulting in a plurality of sheet metal packs being formed such that each of the sheet metal packs has a curved first end area and a second end area opposite the first end area, the second end area having a first end section and a second end section, the first end section having a first end face forming a first angle with a central plane, the second end section having a second end face forming a second angle with the central plane, and the first angle being smaller than the second angle;

providing a mold having a central area;

providing looping devices;

fastening each of the sheet metal packs to one of the looping devices and disposing the looping devices in the central area of the mold; and rotating the looping devices relative to the mold for forming the sheet metal packs into the honeycomb body.

2. The method according to claim 1, which comprises during the folding of the stacks, a substantially greater relative displacement of the sheet metal layers with respect to one another is permitted in the first end section than in the second end section.

3. The method according to claim 2, which comprises during the folding step, the sheet metal layers of the second end section are substantially stationary.

4. The method according to claim 1, which comprises during the folding step, holing a respective stack in at least one area between the second end section and the bending line.

5. The method according to claim 1, which comprises layering the sheet metal layers such that the second end face of the second end section is substantially perpendicular to a longitudinal direction of a respective stack.

6. The method according to claim 1, which comprises forming the stacks such that the sheet metal layers overlap each other.

7. The method according to claim 1, which comprises placing at least two of the sheet metal packs in the mold with the curved first end section in the central area and aligned radially outwards, and the sheet metal packs are held by the looping devices such that as viewed in a direction of a periphery, the first end section alternates with the second end section.

8. The method according to claim 1, wherein a direction of rotation of the looping devices is selected such that each of the sheet metal packs is respectively bent around a bending axis which is substantially parallel to the bending line and adjacent to a section of an outside sheet metal layer between the second end section and the curved end area.

* * * * *